United States Patent [19]

Johdai et al.

[11] Patent Number: 4,955,597

[45] Date of Patent: Sep. 11, 1990

[54] COPYING APPARATUS HAVING A DEVICE FOR HOLDING SHEETS

[75] Inventors: Akiyoshi Johdai; Keichi Kinoshita; Toshio Matsui, all of Toyokawa; Hirokazu Yamada, Toyohashi, all of Japan

[73] Assignee: Minolta Camera Kabushiki Kaisha, Osaka, Japan

[21] Appl. No.: 211,124

[22] Filed: Jun. 21, 1988

Related U.S. Application Data

[62] Division of Ser. No. 49,350, May 13, 1987, abandoned.

[30] Foreign Application Priority Data

May 15, 1986 [JP] Japan ..... 61-112316
May 15, 1986 [JP] Japan ..... 61-73734[U]
May 15, 1986 [JP] Japan ..... 61-73732[U]
May 15, 1986 [JP] Japan ..... 61-73733[U]
Jun. 14, 1986 [JP] Japan ..... 61-138797

[51] Int. Cl.[5] ..... B65H 29/20
[52] U.S. Cl. ..... 271/215; 414/791.2
[58] Field of Search ..... 271/207, 215, 217; 27/213; 414/791.2

[56] References Cited

U.S. PATENT DOCUMENTS 3,709,595 1/1973 Turner et al. .
3,833,911 9/1974 Caldwell et al. .
4,189,133 2/1980 Arrasmith ..... 271/215 X
4,229,650 10/1980 Takahashi et al. ..... 271/215 X
4,318,539 3/1982 Lamos ..... 271/207 X
4,350,333 9/1982 Landa ..... 271/217
4,354,787 10/1982 Gensike ..... 271/217 X
4,548,402 10/1985 Namba .
4,629,173 12/1986 Hashimoto et al. ..... 271/291 X
4,635,920 1/1987 Kodama .
4,664,507 5/1987 Fukae ..... 271/217 X
4,669,717 6/1987 Yamashita et al. ..... 271/291 X
4,718,657 1/1988 Otter et al. ..... 271/217 X
4,718,658 1/1988 Hirose et al. ..... 271/258
4,726,579 2/1988 Kiba et al. .

FOREIGN PATENT DOCUMENTS 203054 11/1984 Japan .

OTHER PUBLICATIONS

IBM Technical Disclosure Bulletin entitled "Sheet Stacking Technique", vol. 17, No. 8, Jan. 1975.

*Primary Examiner*—Richard A. Schacher
*Attorney, Agent, or Firm*—Burns, Doane, Swecker & Mathis

[57] ABSTRACT

A copying apparatus includes an image forming device, a sheet reversal mechanism, and a sheet holding device having a tray, each of the components being independently separable. The sheet reversal mechanism transports to the tray each sheet either in face-up condition or with its face turned downward. The tray is lowered according to the volume of sheets loaded thereon and is caused to shift on a horizontal plane under a specified timing control. The lowering of the tray is effected through detection by a sensor of the volume of sheets loaded on the tray. After each such lowering, any downward movement of the tray is inhibited until a next sheet is loaded on the tray.

3 Claims, 20 Drawing Sheets

COPYING APPARATUS HAVING A DEVICE FOR HOLDING SHEETS

This application is a divisional of application Ser. No. 049,350, filed May 13, 1987, now abandoned.

BACKGROUND OF THE INVENTION

1. Field of the Invention

The present invention relates to a copying apparatus and, more particularly, to a copying apparatus having a sheet holding device designed so that printed-out sheets, discharged one after another from an image forming device of an electrophotographic copying machine, printer, or the like, are reversed, if necessary, and loaded in groups on a sheet holding plate.

2. Description of the Prior Art

Conventionally, a sheet holding device for holding printed-out sheets discharged from an image forming device includes, as Japanese Published Unexamined Patent Application No. 203054/1984 discloses, a shift mechanism for shifting printed-out sheets in groups of a given number of sheets each in side by side relation so as to enable the sheet holding plate to hold a large number of sheets, and an elevating mechanism for moving the sheet holding plate up and down to keep the height of sheet loading on the holding plate at a constant level. If sheets printed out sequentially from a first page are to be arranged in order of pages, as U.S. Pat. No. 3,833,911, issued Sept. 3, 1974 to Caldwell et al., teaches, it is necessary to provide a reversal mechanism by which each sheet discharged from the image forming device, with the image side up, is reversed so that the image side is turned downward.

However, with any such prior-art sheet holding device, in which the sheet reversal mechanism, shift mechanism, and elevating mechanism are integrally combined together, it is impossible to separate one of the mechanisms for combination with such other device as sorter or the like.

Where a sheet holding device adapted to be attached to a printer or copying system in which copying is made beginning with a first page is employed, there must be provided a face-down path along which each copy sheet is transported, with its image side turned downward, for delivery onto a tray in the case of single-side copying, and a face-up path along which each even-paged copy sheet is transported with its image side up for delivery onto the tray in the case of double-side copying. Whichever one of the paths may be employed for transport of sheets, each sheet is finally delivered through a pair of delivery rollers onto the tray.

In this case, however, the trouble is that depending upon whether each sheet is passed through the face-up path or the face-down path, the angle of the sheet relative to the pair of delivery rollers varies, and accordingly the delivery angle of the sheet through the roller pair varies considerably, with the result that the condition of sheet alignment on the tray varies between the case of the one path being used and the case of the other path being used. Another problem is that if the direction of sheet delivery is inclined excessively downward relative to the tray, sheets being delivered are likely to push outward those already loaded on the tray, while, if the direction is inclined excessively upward relative to the tray, .it is likely that some air is included between the sheets being delivered and those on the tray, so that the dropping on the tray of the sheets being delivered becomes irregular, the condition of sheet alignment being thus unfavorably affected.

In any sheet holding device for holding printed-out sheets discharged one after another from an image forming device, the loading capacity of the tray is determined by the depth or distance between the nip portion of the delivery roller pair and the upper surface of the tray. Therefore, in order to increase the loading capacity, it is necessary to set the tray deeper. On the other hand, however, in order to achieve satisfactory alignment of sheets loaded, it is necessary to set the tray less deep. Where a fixed tray system is employed, therefore, the loading capacity is naturally limited because of the relative position of the nip portion and the tray.

For this reason, as aforesaid Japanese Published Unexamined Patent Application No. 203054/1984 indicates, there has been conventionally employed a system such that the tray is lowered according to the volume of sheets loaded on the tray. With such system, it is a usual practice that the timing for the lowering of the tray is determined by a level detection signal from sensor means for detection of upper surface level of sheets loaded on the tray. However, it is possible that if any sheet is obliquely delivered onto the tray or if a curled sheet is delivered, not all delivered sheets may be held in order on the tray. In such case, the trouble is that the level sensing means will maintain itself in output condition for detection signalling so that the tray may be lowered more than required, sheet alignment being thus disturbed.

SUMMARY OF THE INVENTION

It is an object of the present invention to provide a copying apparatus which eliminates aforesaid difficulties and which permits the sheet reversal mechanism and/or sheet holding device to be readily combined with a sorter or the like as desired.

It is another object of the present invention to provide a sheet holding device which can house sheets in orderly alignment whether they are delivered through a face-up path for transporing sheets while keeping their image side up or through a face-down path for transporting sheets after reversing them into image side down condition.

It is a further object of the present invention to provide a sheet holding device of the type in which a sheet holding plate can be lowered as desired, wherein the holding plate is prevented from being lowered more than required in order to effectively eliminate the possibility of sheet alignment disturbance.

Accordingly, the copying apparatus in accordance with the present invention comprises an image forming device for forming an image on a sheet, a sheet reversal mechanism which is able to selectively reverse sheets to turn their image side downward or upward as they are discharged from the image forming device, and a sheet holding device for holding in position sheets delivered from the sheet reversal mechanism, said reversal mechanism being removably mounted to the image forming device, said sheet holding device being removably mounted to the reversal mechanism. The sheet holding device has a mechanism for lowering the sheet holding plate according to the volume of sheets loaded thereon, and a mechanism for shifting the sheet holding plate on a horizontal plane under a predetermined timing control. The sheet reversal mechanism includes a face-up path for transporting sheets while keeping their image side up and a face-down path for transporting sheets after reversing them so that their image side is turned downward. The copying apparatus in accordance with the present invention has control means which allow the sheet holding plate to be lowered a specified amount according to the output of sensor means for detecting the volume of sheets delivered onto the sheet holding plate and which inhibits a further downward movement of the sheet holding plate after said specified amount of downward movement thereof and until a subsequent sheet loaded operation.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

An embodiment of the present invention will be described below with reference to the drawings.

General Aspect

Figure 1:
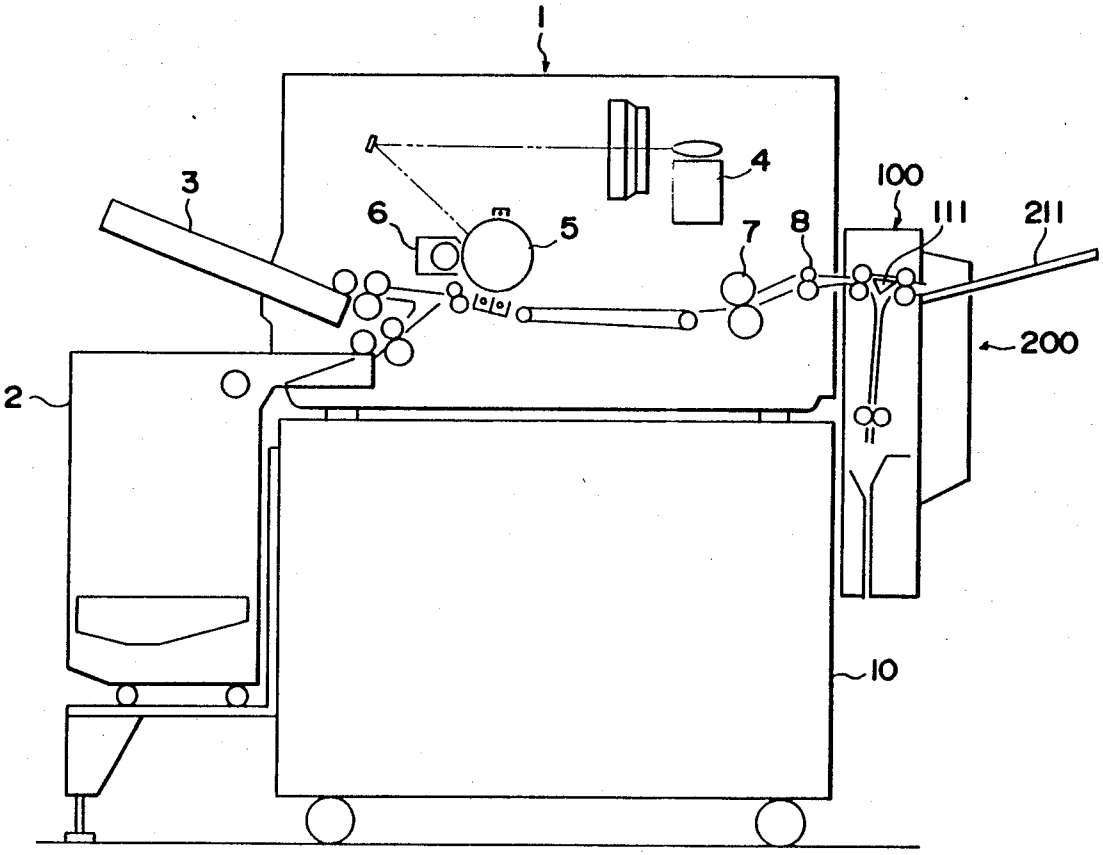
FIG. 1 is a schematic block diagram showing one embodiment of a copying apparatus in accordance with the invention.

In FIG. 1 the copying apparatus in accordance with the invention comprises a printer 1 provided on a desk 10, a transport/reversal block 100 removably mounted to the sheet discharge end of the printer 1, and a selective holding block 200 having a tray 211 for receiving sheets. The printer 1 has an elevator type feeder device 2 and a cassette type feeder device 3. A latent image is formed on a photosensitive drum 5 under laser beams from a laser beam device 4. After developed by a developing device 6, the latent image is transferred onto a printing sheet. The sheet onto which such image is transferred is subjected to fixation by a fixing device 7 and is then delivered through a pair of discharge rollers 8 to the transport/reversal block 100, with the transferred image side turned upward.

The transport/reversal block 100, in turn, delivers the sheet onto the tray 211, with its image face kept upside or turned down, as will be further described hereinafter. The tray 211, as will be described hereinafter, shifts on a horizontal plane at a certain pitch each time a specified number of sheets are delivered thereto, and moves downward according to the volume of sheets loaded thereon.

Transport/Reversal Block

Figure 2:
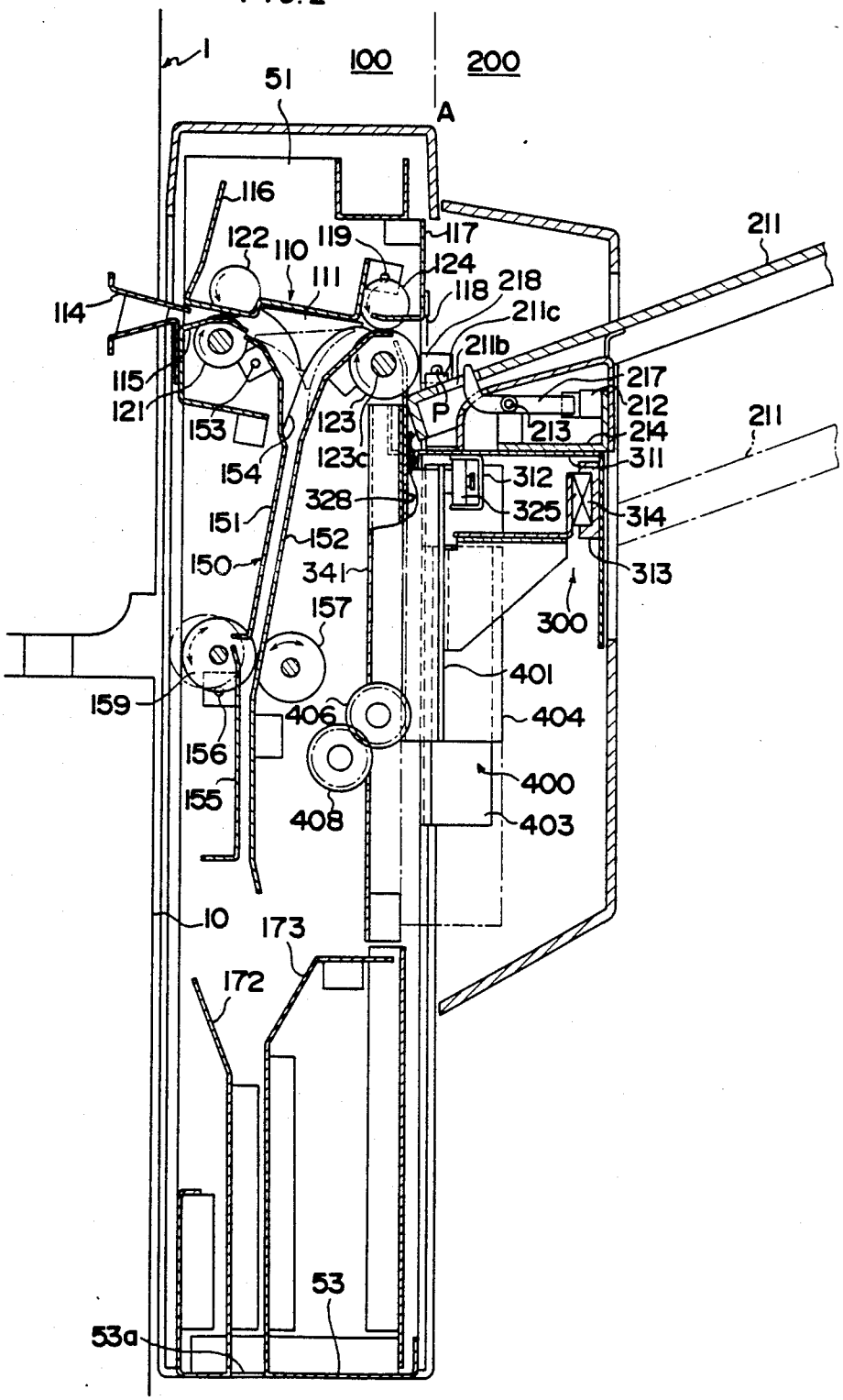
FIG. 2 is a vertical sectional view showing a transport/reversal block.
Figure 3:
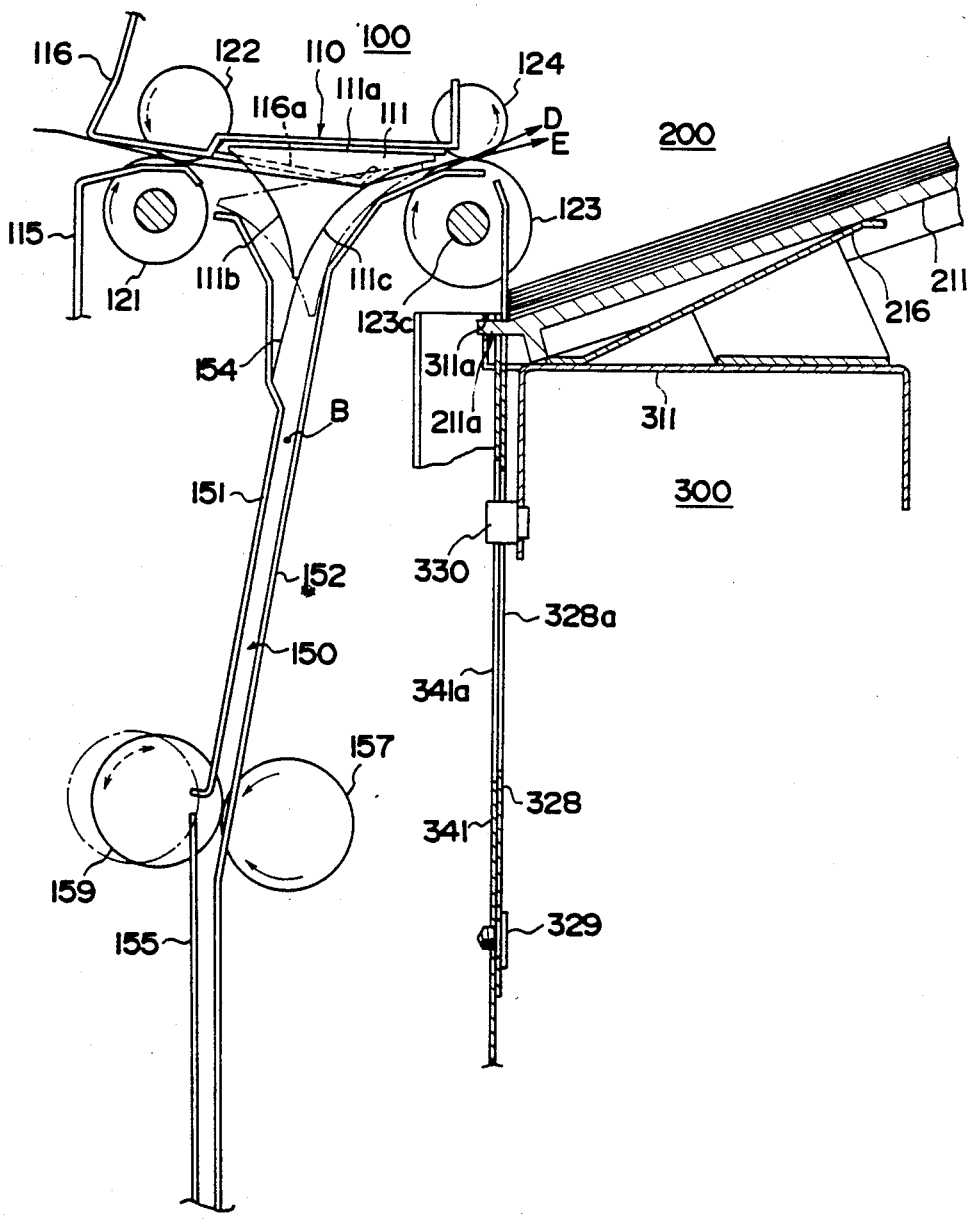
FIG. 3 is a vertical sectional view illustrating paths of sheet travel in the transport/reversal block.

As FIGS. 2 and 3 show, the transport/reversal block 100 comprises a face-up path 110 for transporting a sheet discharged from the printer 1 while keeping its image side up, a face-down path 150 for reversing such sheet to turn its image side down, and a changeover pawl 111 for selecting one of the paths, said components being disposed within a frame 51 fixed to one side of the printer 1.

The face-up path 110 consists of an inlet guide plate 114, guide plates 115, 116, 117, lead-in rollers 121, 122, and delivery rollers 123, 125. The rollers 121, 123 are driven by drive means not shown to rotate clockwise, and the rollers 122, 124 are rotatable by contact with the rollers 121, 123.

Figure 4:
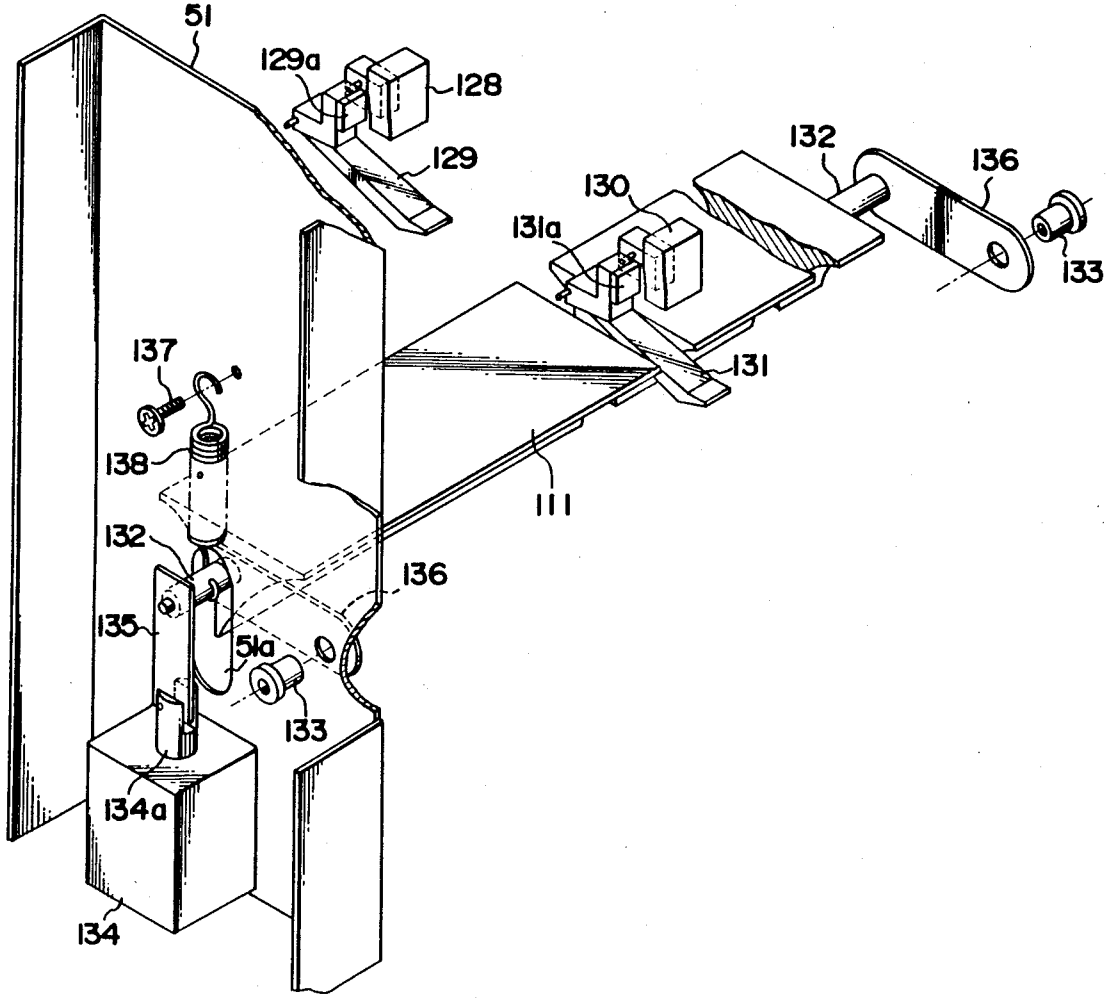
FIG. 4 is a perspective view of a changeover pawl portion.

The changeover pawl 111, being of generally triangular configuration, has an upper guide face 111*a* and accurate side guide faces 111*b*, 111*c*, the guide face 111*c* having a elastic sheet attached thereto. As FIG. 4 shows, this changeover pawl 111 is fixed through shafts 132, 132 to respective front ends of levers 136, 136 pivotally mounted to the frame 51 through bearings 133, 133. One of the shafts 132 projects through an elongate slot 51*a* bored in the frame 51 and is connected at the projecting end thereof to a plunger 134*a* of a solenoid 134 through a lever 135, being in lock engagement with a tension coil spring 138 fastened by a machine screw 137 to the frame 51.

A support shaft 123*c* of the delivery rollers 123 is supported in the bearings 133, 133. The changeover pawl 111 is pivotable about the support shaft 123*c*. Thus, the changeover pawl 111 is normally set by the coil spring 138 at the solid line position in FIGS. 2 and 3 when the solenoid 134 is in its off condition, and if the solenoid 134 is turned on, the pawl 111 is set to the dashed line position in FIGS. 2 and 3 in conjunction with the lowering of the plunger 134*a* and lever 135.

Figure 5:
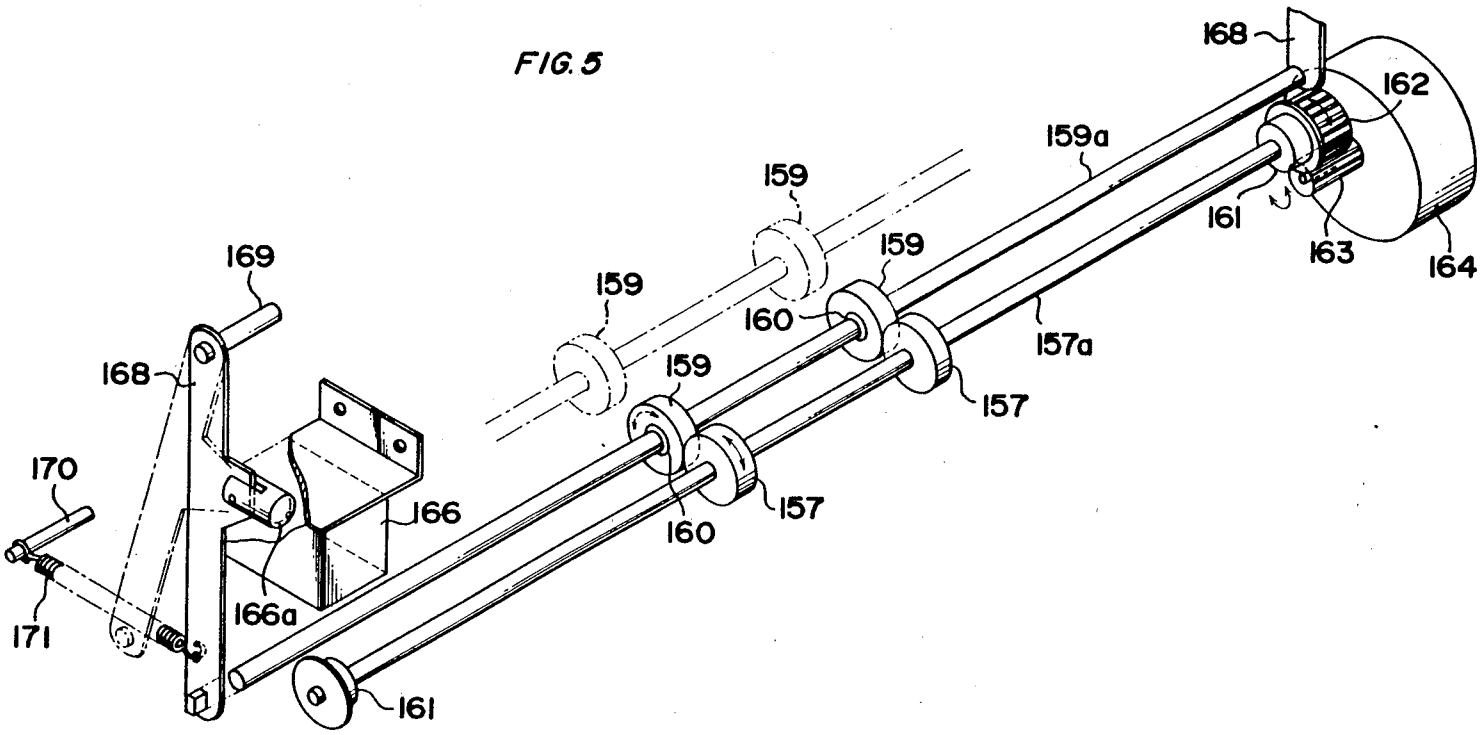
FIG. 5 is a perspective view of a reversing roller portion.

The face-down path 150 consists of guide plates 151, 155, 152, 172, 173, reversal rollers 157, and pinch rollers 159. The reversal rollers 157, as FIG. 5 shows, are fixedly mounted on a support shaft 157*a* mounted in the frame 51 through bearings 161, 161. A driven gear 162 fixed to one end of the support shaft 157*a* is in mesh with an output gear 163 of a reversible pulse motor 164. A support shaft 159*a* of the pinch rollers 159 is fixed at both ends thereof to the respective lower ends of pivotal levers 168, 168. The pivotal levers 168, 168 each, being pivotable about a pin 169, is connected to a plunger 166*a* of a solenoid 166 and is in lock engagement with a tension coil spring 171 fastened by a pin 170 to the frame 51. Thus, the pinch rollers 159 are normally set by coil spring 171 to the dashed line position in FIGS. 2 and 5 when the solenoid 166 is in its off condition, being thereby kept away from the reversal rollers 157. When the solenoid 166 is turned on, the pinch rollers 159 are moved to the solid line position in FIGS. 2 and 5 in conjunction with the backward movement of the plunger 166*a*, being thereby pressed against the reversal rollers 157.

In the face-up path 110, as FIG. 4 shows, there are disposed sensors 128, 130 which detect the passage of sheets. The sensors 128, 130 each consists of a reed switch which is actuated by a magnet 129*a*, 131*a* mounted to an actuator 129, 131. The sensor 128 and the actuator 129 are mounted to the guide plate 116, and the sensor 130 and the actuator 131 are mounted to the guide plate 117. The actuator 129 operates at a location slightly upstream of the nip portion of the lead-in rollers 121, 122 in the direction of sheet transport to detect the front and rear ends of each sheet, and the other actuator 131 operates at a location slightly downstream of the nip portion of the delivery rollers 123, 124 in same direction onto detect the front and rear ends of the sheet.

Operation of sheet transport will be explained in this conjunction.

Selection as to whether a sheet discharged from the printer 1 is to be passed through the face-up path 110 without being reversed or is to be passed through the face-down path 150 for reversal is made by operating a key (not shown) located outside the frame 51. The sheet holding device is so designed that the face-down path 150 is selected at initial stage.

Normally, the solenoid 134 is in its off condition so that the changeover pawl 111 is set at the solid line position shown in FIG. 2, the lower end of the elastic sheet 154 being in contact with the guide plate 151. The solenoid 166 is also in its off condition sc that the pinch rollers 159 are kept away from the reversal rollers 157. Each sheet discharged from the printer 1 is carried forward while being held between the lead-in rollers 121, 122, and as its front end goes in contact with the side guide face 111*b* of the changeover pawl 111, the sheet is guided downward to push the elastic sheet 154 open, being thereby conveyed further downward along the face-down path 150. When the rear end of the sheet is detected by the sensor 128 right before it passes through the lead-in rollers 121, 122, the solenoid 166 is turned on and the pulse motor 164 is driven forward. Thereupon, the pinch rollers 159 are pressed against the reversal rollers 157, thereby holding the sheet in cooperation with the latter. The reversal rollers 157 are then driven forward to rotate counterclockwise and the sheet is transported further downward. At a specified point of time after detection by the sensor 128 of the rear end of the sheet, which time is set by a timer or more specifically when the rear end of the sheet has reached point B (see FIG. 3) after passing through the elastic sheet 154, the pulse motor 164 is switched over for reverse run. Then, the reversal rollers 157 are driven in reverse for clockwise rotation and the sheet is transported upward (being thus reversed).

In this reversal transport, the sheet is conveyed upward along the side guide face 111*c* of the changeover pawl 111 while being guided at its front end by the elastic sheet 154. When the front end of the sheet in course of the reversal transport is detected by the sensor 130 right after it is put between the delivery rollers 123, 124, the solenoid 166 is turned off and the reverse run of the pulse motor 164 is stopped. Thus, the pinch rollers 159 are moved away from the reversal rollers 157 and the reverse run of the reversal rollers 157 is stopped. The sheet is then delivered onto the tray 211 through the rotation of the delivery rollers 123, 124, with its image side turned downward.

If the sheet is of a long size, the front end of the sheet passes between the guide plates 152 and 155 and further between the guide plates 172 and 173, being thus temporarily allowed to project downward through an opening 53*a* provided in a bottom plate 53.

When the face-up path 110 is selected, the solenoid 134 is turned on and the changeover pawl 111 is set at the dashed line position. Each sheet discharged from the printer 1 is transported forward by being carried between the lead-in rollers 121, 122 in the same manner as above described, and is further transported while being guided at its front end along the upper guide face 111*a* of the changeover pawl 111; thus, the sheet is delivered onto the tray 211 through the delivery rollers 123, 124, with its image face turned upside.

When the sheet is delivered onto the tray 211, it is destaticized by a static eliminator brush ]18 mounted to the guide plate 117.

Now, the relations between the individual roller 121, 157, 123 of the transport/reversal block 100 in respect of peripheral rotation speed and inter-roller distance will be explained with reference to FIG. 3.

Assume the peripheral speed of the lead-in rollers 121 is V1, that of the reversal rollers 157 is V2 during forward run and V3 during reverse run, and that of the delivery rollers is V4. Peripheral speeds of these rollers are set according to the following relations:

$$V1 \leqq V2 \leqq V3 \leqq V4 \quad (1)$$

The reason for such peripheral speed settings is that for the purpose of sheet transport, sheet delivery at an equal or greater speed in the direction of transport is desired.

Again, assume the length of the sheet is L, the distance between the nip portion of the lead-in rollers 121, 122 and the sheet reversal point B is L1, the distance between point B and the nip portion of the reversal rollers 157, 159 is L2, and the distance between point B and the nip portion of the delivery rollers 123, 124 is L3. Since the sheet must be held by any one of the roller pairs during the transport thereof, it is necessary that L1, L2, and L3 should be set according to the following relations:

$$L > L1 + L2 \quad (2)$$

$$L > L2 + L3 \quad (3)$$

Assuming that the interval between each successive two sheets being transported is 1, setting according to the following relation is required:

$$L2/V3<(1+L2)/V1 \quad (4)$$

The reason for this is that the front end of a next succeeding sheet should be prevented from reaching the reversal rollers 157, 159 [(1+L2)/V1] before the front end of a preceding sheet which has been reversed is held between the delivery rollers 123, 124 (L2/V3).

In order to ensure accurate reversal/transport of sheets, it is also important that prior to the passage through the reversal rollers 157, 159 of the rear end of a reversed sheet the rear end of a next succeeding sheet should not pass through the lead-in rollers 121, 122. Assume the distance between the rear end of a sheet at reversal timing and the nip portion of the reversal rollers 157, 159 is L4. Then, there must be the following relationship:

$$L3/V3+(L4-L3)/V4 <(L-L1-1) \quad (5)$$

In the sheet holding device, as FIG. 3 shows, the guide plate 116 is provided with a projecting piece **116*a*. This projecting piece 116*a*, located between changeover pawls 111 provided in plurality, is opposed to the upper guide face 111*a* of the one changeover pawl 111 (shown by dashed line in FIG. 3) applicable in the case of the face-up path 110 being selected and is present nearer to said upper guide face 111*a* than is a straight line connecting between the nip portion of the lead-in rollers 121, 122 and the nip portion of the delivery rollers 123, 124. Thus, each sheet being transported along the face-up path 110 is first guided downward by the projecting piece 116*a* and then held between the delivery rollers 123, 124 at an upward angle, so that it is delivered onto the tray 211 at such an angle as indicated by the arrow D. This angle of sheet delivery in the case of the face-up path 110 is about equal to the directional angle of sheet delivery in the case of the face-down path 150**.

Whichever path may be selected, the face-up path or the face-down path, angle setting for sheet delivery to the tray 211 should be made in such way that each sheet being delivered is prevented from pushing any previously loaded sheet out of the tray 211 (if the sheet is excessively down-angled, there is the possibility of a previously loaded sheet or sheets being pushed out) and that sheet dropping points on the tray 211 is prevented from distributing randomly (if the sheet is excessively up-angled, sheet dropping points may be randomly distributed due to the inclusion of air between sheets). With the face-up path 110 in particular, it is likely that unless aforesaid projecting piece **116*a* is provided, a previously loaded sheet or sheets will be pushed out of the tray 211** because the direction of sheet delivery is inclined to be generally horizontal.

In the present embodiment, therefore, the guide plate 116 is provided with aforesaid projecting piece **116*a*, whereby the angle of sheet delivery form the face-up path 110 is made wider in order to eliminate above mentioned difficulty. Furthermore, the fact that the angles of sheet delivery form the two paths 110, 150 are generally equal assures uniform sheet alignment on the tray 211 which one of the paths 110, 150** may be selected for sheet transport.

It is noted in this conjunction that the angle of sheet delivery from the face-down path 150 is set as small as practical by adjusting the curvature of side guide face **111*c* of the changeover pawl 111 and/or the setting angle of the pawl 111 in the case of the face-down path 150** being selected.

Where the face-down path 150 is selected, the projecting piece **116*a* is in overlapping relation with the changeover pawl set to the solid line position in FIG. 3. Thus, the front end of each sheet led in through the rollers 121, 122 when the face-down path 150 is selected can be accurately guided for abutment with the side guide face 111*b*** in order to assure smooth transport of sheets and to prevent any sheet jamming.

As FIG. 2 shows, the guide plate 116 is supported rotatably in clockwise by the frame 51 to open the face-up path 110. Similarly, the guide plates 151, 155 are supported rotatably in clockwise by the frame 51 through pins 153, 156 respectively to open the face-down path 150. Such arrangement is intended to facilitate the elimination of any sheet jamming which may be caused in the face-up and face-down paths. In the face-up path 110 in particular, the lead-in rollers 122 disposed on the guide plate 116 can be moved upward for retreat from the way in that conjunction.

Sheet Holding Device

As FIG. 2 shows, the tray 211 is removably mounted on a support member 216 fixed to a retainer plate 311 and has a projection **211*a* (see FIG. 3) at its front end which is engageable with a hole 311*a* of the retainer plate 311 for positioning of the tray 211. An actuator 217 is mounted to the retainer plate 311 through a bracket 214, said actuator 217 being rotatable about a pin 213. The front end of the actuator 217 projects upward through an opening 211*b* of the tray 211, and the rear end thereof serves to screen a transducent photosensor 212. The sensor 212 detects the presence or absence of sheets on the tray 211. When sheets are delivered onto the tray 211 as above described, their weight causes the actuator 217 to rotate counterclockwise about the pin 213, so that the rear end of the actuator 217 moves away from the optical axis of the sensor 212** to actuate the sensor.

Figure 19:
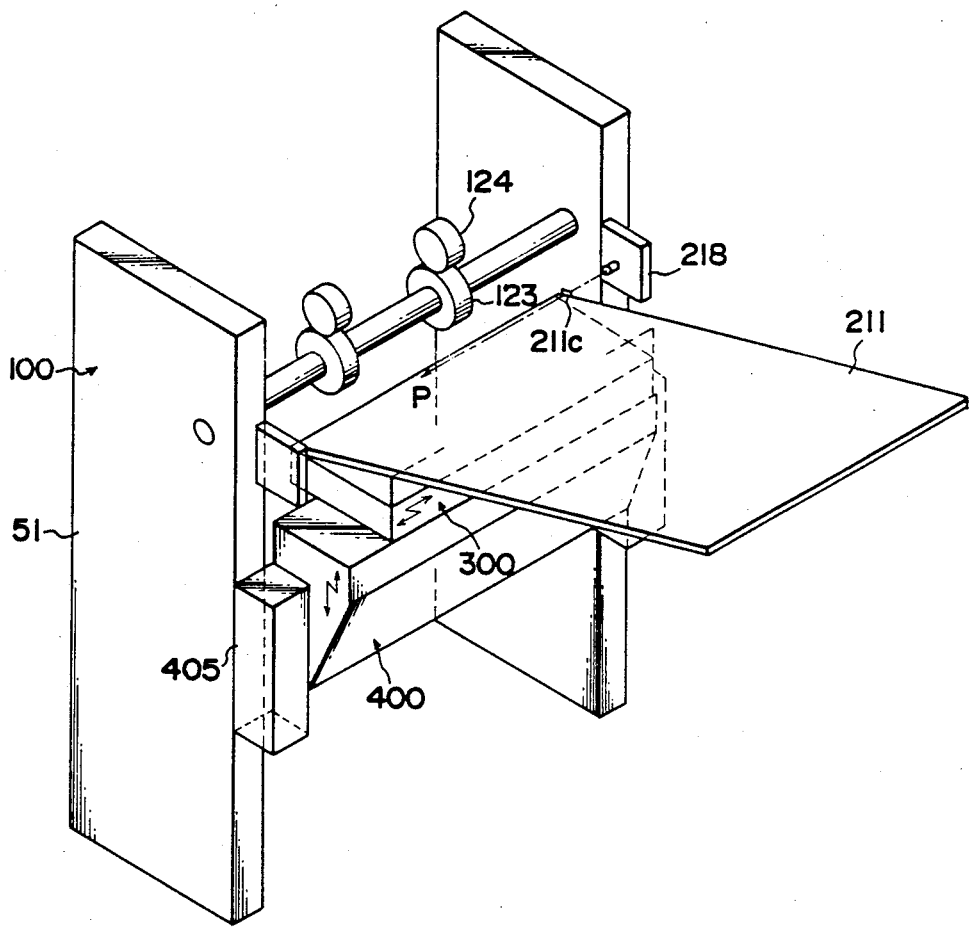
FIG. 19 is a schematic view in perspective of a sheet holding device as seen in some of the foregoing figures.

As FIGS. 2 and 19 show, a transducent photosensor 218 is disposed in the frame 51 so that an optical axis P crosses the entrance of the tray 211 in the widthwise direction of each sheet. This sensor 218 operates when a specified number of sheets have been loaded on the tray 211 so that the optical axis P is intercepted. It actuates an elevating block 400, which will be described in detail hereinafter, to lower the tray 211.

Shift Block

Figure 6:
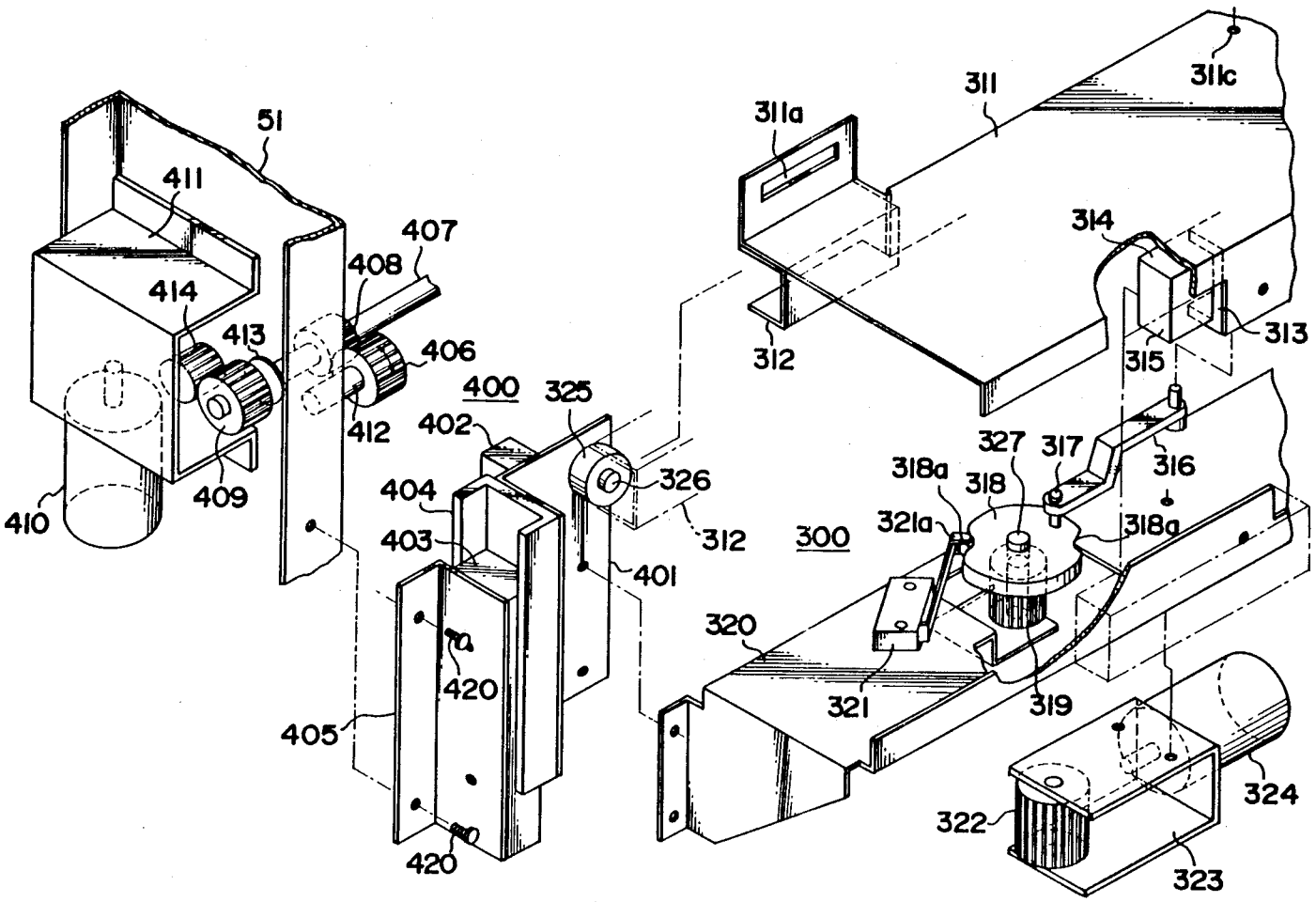
FIG. 6 is an exploded view in perspective of shifting and elevating motion drive units.

As can be seen from FIG. 6, the tray retainer plate 311 is movable in perpendicular relation to the direction of sheet transport by such a construction that a slide rail 314 engages a stationary side rail 313 fixed to a mounting plate 320 and a guide 312 engages a guide roller 325 mounted rotatably to a bracket 401 of an elevating block 400 through a pin 326. The mounting plate 320 is fixed by screws to the bracket 401. On the underside of the mounting plate 320 there are mounted a gear box 323 comprising, in assembly, a shifting motor 324, a reduction gear mechanism not shown, and a final stage output gear 322 thereof, and a cam 318 rotatably mounted on a pin 327, said output gear 322 being in mesh with a gear 319 integral with the cam 318. A pin 317 fixed on the upper surface of the cam 318 extends upwardly from the upper surface of the mounting plate 320, said pin being connected to one end of a shift lever 316. The other end of the shift lever 316 is connected to the retainer plate 311 through a pin 315 which is fitted into a hole 311*c*. On the outer periphery of the cam 318 there are formed recessed portions 318*a*, 318*a* at two opposite locations, with which an actuator 321*a* is engageable for actuation of a microswitch 321.

Figure 7:
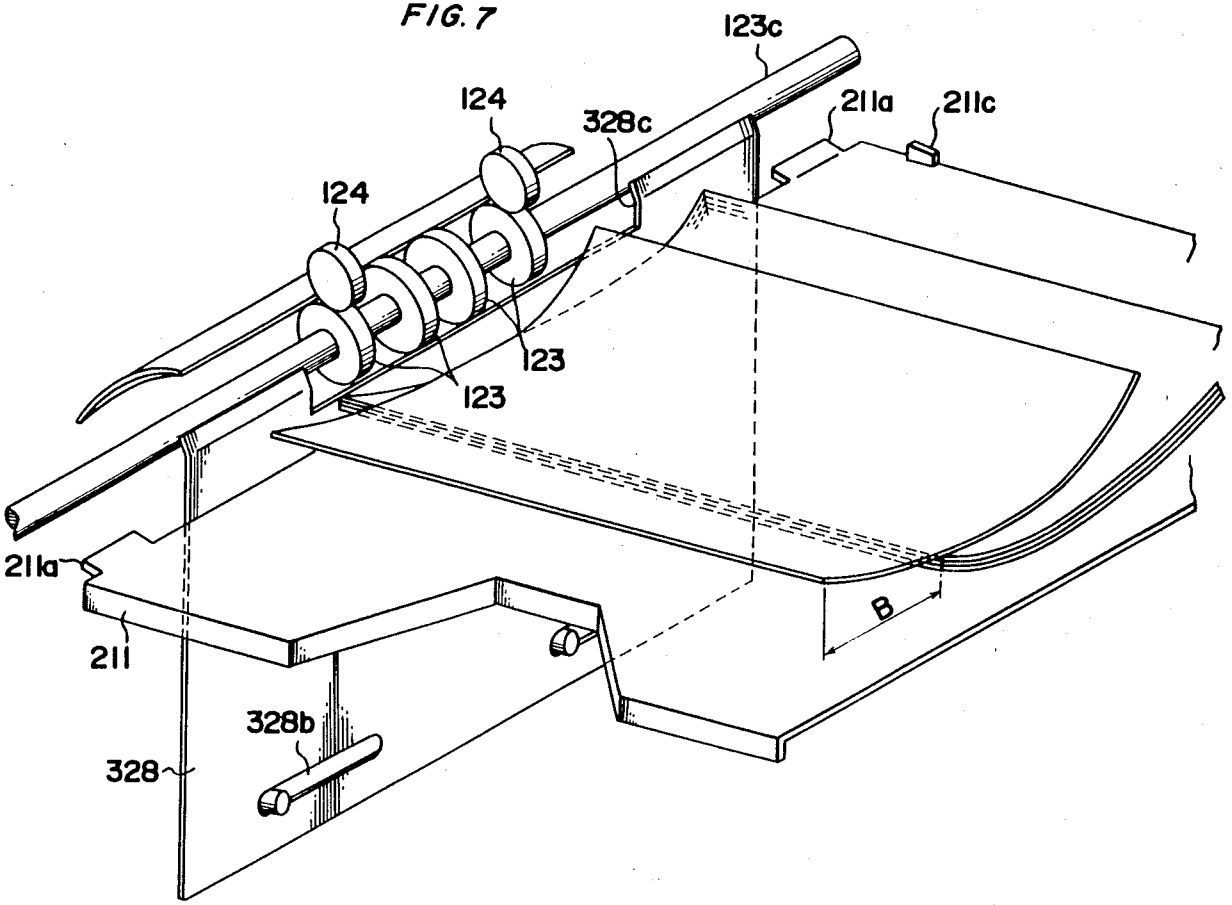
FIG. 7 is a perspective view illustrating delivery of sheets onto a tray.

According to the above arrangement, when a specified number of sheets have been loaded on the tray 211, a motor 324 is driven to rotate the cam 318 clockwise. And when the actuator 321*a* of the microswitch 321 goes into engagement with the next recessed portion 318*a*, the motor 324 stops running. That is, each time when the number of sheets loaded on the tray 211 reaches a specified number, the cam 318 rotates 180° to move the retainer plate 311 backward and forward (shift) in the widthwise direction of sheets, in conjunction with the tray 211. The quantity of shift (B) in this case (see FIG. 7) is two times the throw of the pin 317, and thus sheets are grouped in terms of specified units.

Figure 8:
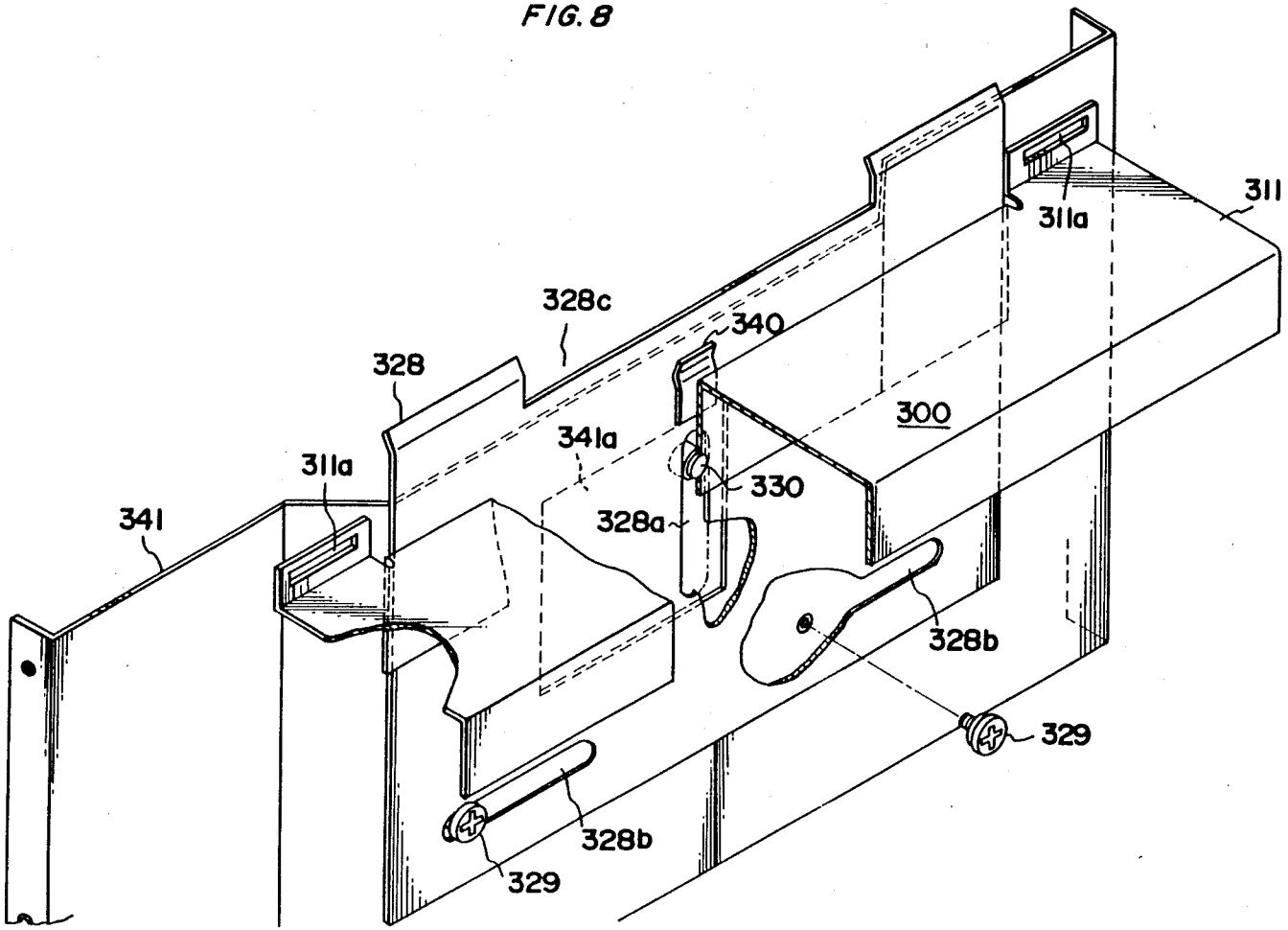
FIG. 8 is a perspective view showing a rear end regulator plate as it appears when mounted in position.

Further, as FIGS. 2 and 8 show, the sheet holding device includes a rear end regulating plate 328 for regulating the rear ends of sheets loaded on the tray 211 and a back plate 341 fixed to the frame 51. The rear end regulating plate 328 has an elongate slot 328*a* formed therein in the longitudinal direction,. which is engaged by a pin 330 fixed to the retainer plate 311, and horizontally elongate slots 328*b*, 328*b*, which are engaged respectively by stepped screws 329, 329 fixed threadedly to the back plate 314, the regulating plate 328 being fixedly attached to the back plate 341 by a leaf spring 340 fixed to the retainer plate 311.

In the above said grouping operation, when the retainer plate 311 shifts in conjunction with the tray 211, the rear end regulating plate 328 shifts synchronously with them, because the pin 330 is in engagement with the longitudinally elongate slot 328*a*. In this case, the shifting of the rear end regulating plate 328 is guided by the horizontal elongate slots 328*b*, which are in engagement with the respective stepped portions of the screws 329. When the retainer plate 311, together with the tray 211, is move upward or downward through the movement of the elevating block 400, which will be hereinafter described in detail, the rear end regulating plate 328 retains its level as it is, because the pin 330 is guided by the longitudinally elongate slot 328*a*. The back plate 341 has a large square hole 341*a* formed therein which permits movement of the pin 330 during both shifting and elevating operation.

Such synchronous shifting of the rear end regulating plate 328 and the tray 211 is intended to eliminate the possibility of irregular sheet alignment being caused by any frictional contact between the rear ends of the sheets on the tray 211 and the rear end regulating plate 328 during shifting operation. It is understood, however, that the rear end regulating plate 328 does not move up or down, its level being constantly same. The position of the upper end of the rear end regulating plate 328 relative to the delivery rollers 123 must be constantly maintained at same level in order to ensure accurate delivery and holding of sheets.

Figure 10:
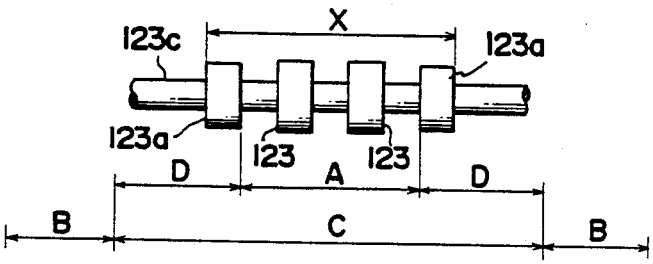
FIG. 10 is a schematic diagram showing the arrangement of delivery rollers.

Positional Relationship between the Rear End Regulating plate and the Delivery Rollers Referring to the relative positions between the rear end regulating plate 328 and the delivery rollers 123, it can be seen from FIGS. 2 and 3 that the delivery rollers 123 and the upper end of the regulating plate 328 are in overlapping relation in the direction of sheet transport. Thus, each sheet is accurately delivered onto the tray 211 irrespective of the presence of the regulating plate 328. Further, as FIG. 10 shows, the rear end regulating plate 328 has at its upper end a cutaway portion 328*c* extending in the widthwise direction of sheets (see FIGS. 7 and 8), which is slightly larger than the distance X between the extremities of two outer rollers 123*a*, 123*a* plus the quantity of shift B. By virtue of this cutaway portion 328*c* the regulating plate 328 is effectively prevented from going into contact with the delivery rollers 123 when it is shifted in the widthwise direction of sheets.

Disposition of Delivery Rollers

As FIG. 10 shows, the delivery rollers 123 consist of a plurality of ring-shaped rollers mounted in side by side relation on a support shaft 123*c*, and two outer rollers 123*a*, 123*a* thereof are so disposed that their respective inner sides (distance A) do not contact sides edges of a sheet of a minimum width C when sheets of such width shift over a distance B. In this case, the distance D between the inner sides of the outer rollers 123*a*, 123*a* and the side edges of the sheet of minimum width is slightly greater that the quantity of shift B. Accordingly, when sheets, together with the tray 211 are shifted by quantity B in the widthwise direction, it is unlikely that each sheet, if curled upward as a result of its passage through the toner fixing device 7 or the like of the printer 1, goes in contact at its side edges with the inner sides of the outer rollers 123*a*, 123*a*. Thus, there is no possibility of irregular alignment of sheets on the tray 211.

Figure 11:
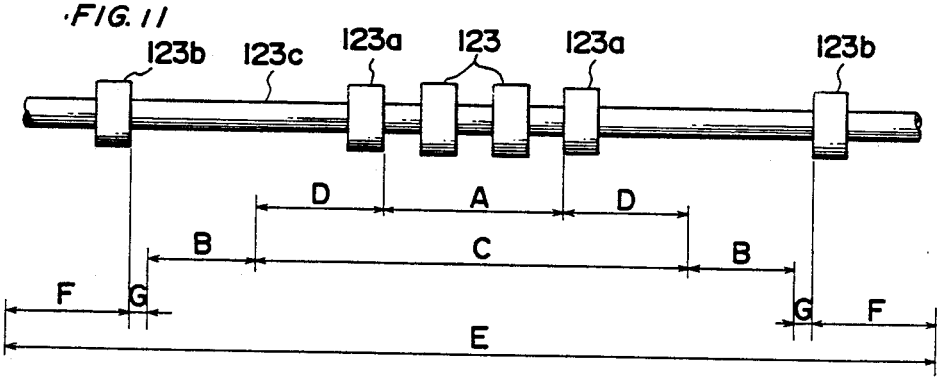
FIG. 11 and 12 are schematic diagrams showing modified forms of delivery roller arrangement.

It is important that the plurality of delivery rollers 123 should be so disposed that their inner sides do not interfere with the side edges of each sheet during shift movement of the tray 211. As FIG. 11 shows, however, additional rollers 123*b*, 123*b* may be provided anywhere outside the rollers 123*a*, 123*a*, if they are disposed at locations where they are unlikely to interfere with the sheet. That is, rollers 123*b*, 123*b* should be so disposed that the dimension F from their respective inner sides to side edges of a sheet having a widthwise dimension D is greater than the quantity of shift B and that the gap G between said inner sides and side edges of the sheet of minimum width C during shift movement is more than zero.

Figure 12:
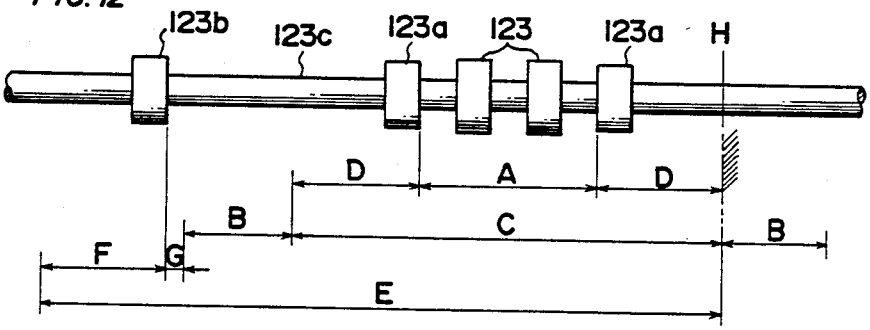

Description has been given above about the system of middle basis transport. It is understood, however, that the above described disposition of delivery rollers 123 is applicable to the side transport system with some modification. FIG. 12 shows one example of such modification.

Elevating Block

The elevating block 400 is designed to move the tray 211 upward and downward while supporting the shift block 300.

As FIG. 6 shows, the bracket 401 which supports the mounting plate 320 for the shift block 300 is up and down movable by the slide rail 404 engaged with the stationary rail 403 fixed to the brackets 405. The brackets 405 are fixed by bolts to both sides of the frame 51. In the frame 51 there is mounted a gear box 411 comprising in combination a reversible elevating motor 410, a reduction gear mechanism not shown, and a final stage output gear 414 thereof. Gears 408, 409 are fixed to a drive shaft 407 which is rotatably mounted in the frame 51 through bearings 413. The gear 409 is in mesh with the output gear 414, and the gear 408 is in engagement with a pinion 406 mounted to the frame 51 through a support shaft 412. The pinion 406 is in mesh with a rack 402 fixed to said bracket 401.

Accordingly, when the motor 410 is driven forward, the pinion 406 is rotated clockwise through the output gear 414 and the gears 409, 408, so that the tray 211 is lowered in conjunction with the brackets 401, the mounting plate 320, and the retainer plate 311. When the motor is driven reverse, the pinion 406 is rotated counterclockwise to elevate the tray 211.

Figure 9:
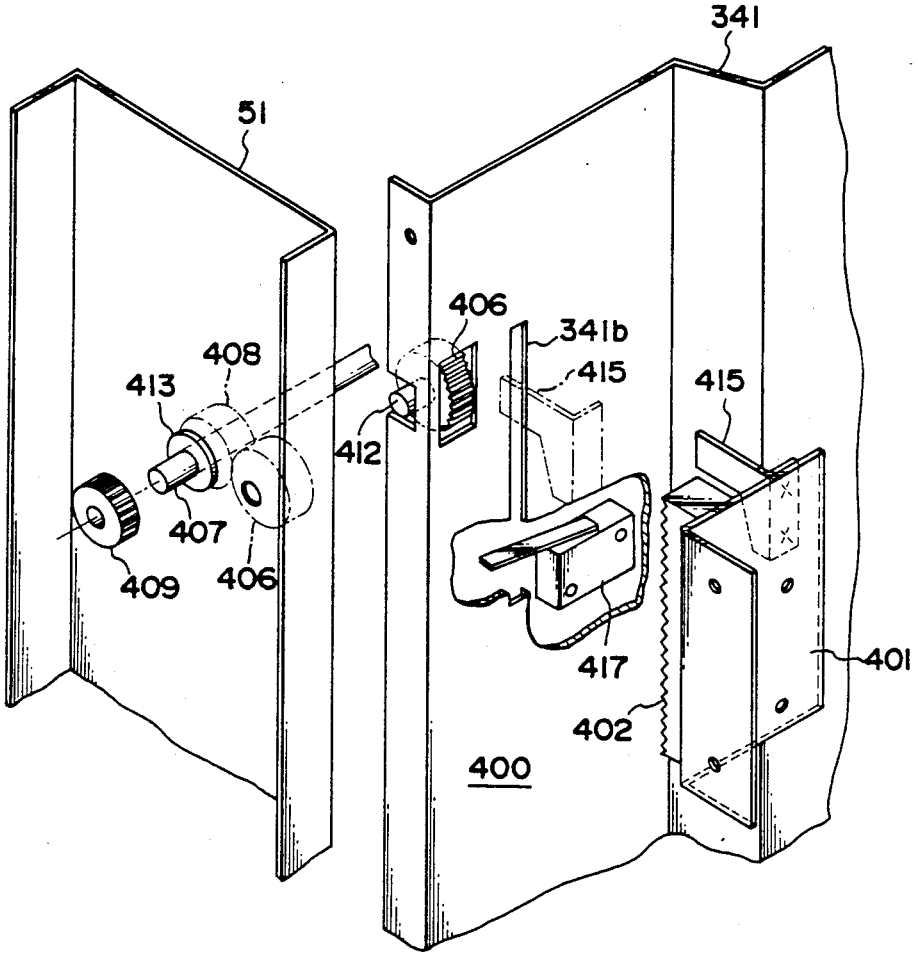
FIG. 9 is an exploded view in perspective of the elevating motion drive unit.

As FIG. 9 shows, a lever 415 mounted to the bracket 401 extends through a slit **341*b* provided in the back plate 341 and has a function to on/off control microswitches 415, 417 fixed to the rear side of the back plate 341 at upper and lower portions thereof. The motor 410 is controlled for forward and reverse run by on/off signals from the microswitches 416, 417 and on/of signals from the sheet level detecting sensor 218**.

When the tray 211 is at its uppermost position, the lever 415 turns on the upper limit detecting switch 416. The optical axis P (P: sheet level detection point) of the sensor 218, as FIGS. 2 and 19 show, is set slightly higher than the loaded sheet surface of the tray 211. Now, when the upper most layer of sheets intercepts the optical axis P, the sensor 218 is turned on and the motor 410 is driven forward for a given period of time to lower the tray 211 a certain amount. Each time the sensor 218 is turned on in response to a specified increase in the number of sheets, the motor 410 is driven forward to cause an intermittent downward movement of the tray 211. When the tray 211 has been lowered to its lowermost position, the lever 415 turns on the lower limit detecting switch 417, which issue a print forbidden signal to the control unit of the printer 1.

The motor 410 is actuated to run reverse when the empty detecting sensor 212 ascertains removal of sheets from the tray 212. Then, the shift block 300, including the tray 211, is elevated. This upward movement is stopped when the upper limit detecting switch 416 is turned on by the lever 415.

Separation of In-group Holding Block

As can be understood from the above given description, the in-group holding block 200 consisting of the shift block 300 and the elevating block 400 is removably mountable to the transport/reversal block 100 having the face-up and face-down paths 110, 150. Separation of the in-group holding block 200 can be readily done by removing bolts 420 and thereby removing the brackets 405 from the frame 51. However, the motor 410 and pinion 406 of the elevating block 400 remains mounted to the frame 51. It is noted that these components are mounted to the frame 51 only for effective utilization of limited space.

The transport/reversal block 100 and the in-group holding block 200 are separable from each other along a vertical plane indicated by the dashed line A in FIG. 1; therefore, after the in-group holding block 200 is separated from the transport/reversal block 100, it is possible to attach a sorter 70 or the like to the transport-/reversal block 100. Thus, it is possible to employ the sorter 70 in conjunction with the face-down path.

Control System

Figure 13:
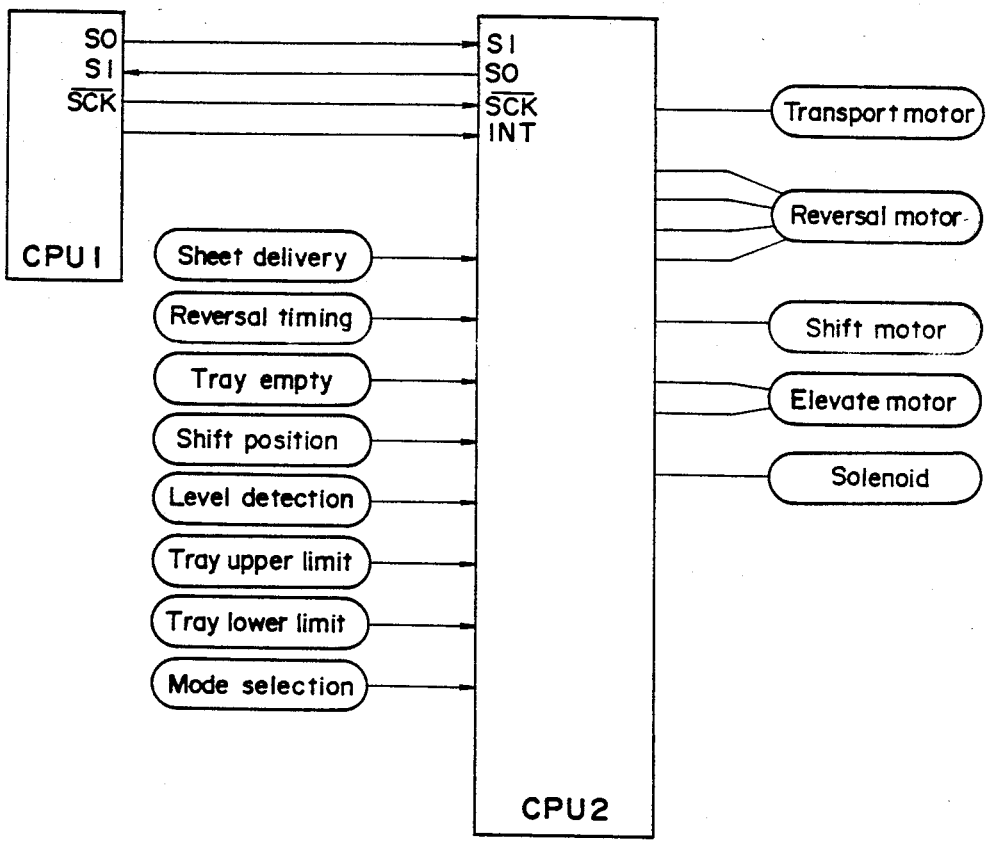
FIG. 13 is a control circuit diagram for a CPU employed in the copying apparatus.

Nextly, a control system for key components of the apparatus of the invention will be explained with reference to FIG. 13.

Reference character CPU1 designates a first microcomputer for controlling the operation of the printer 1, and CPU2 designates a second microcomputer for controlling the operation of the sheet holding device, signals being exchangeable between the two microcomputers. The input port of CPU2 receives sheet delivery signals from the sensor 130, timing signals from the sensor 128 for sheet reversal, tray empty signals from the sensor 212, upper surface level detection signals from the sensor 218, tray upper limit signals from the switch 416, tray lower limit signals from the switch 417, and mode selection signals including sheet transport path selection and number of sheets designation. From the output port are issued on/off signals to the transport and reversal motors 164 for driving the rollers 121, 122, shift motor 324, elevate motor 410, and solenoids 134, 166.

Details of Control

Now, details of control by means of the control system for the above described copying apparatus of the invention will be explained with reference to FIGS. **14–18*a*, 18*b***.

Figure 14:
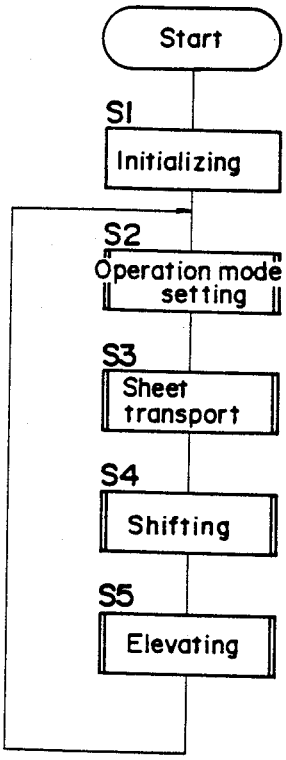
FIG. 14 is a flow chart showing a main routine of the CPU.

FIG. 14 shows a main routine of the second microcomputer CPU2.

When operation is started, initialization is carried out at step S1 for setting signals of initial modes. Thereafter, at steps S2–S5, subroutines hereinafter described are repeatedly called in sequence and necessary operations are carried out.

Figure 15:
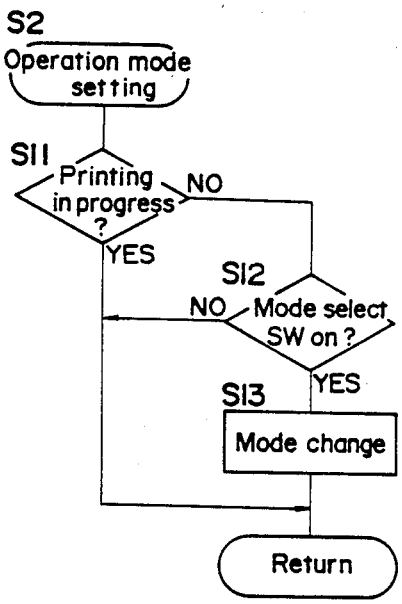
FIG. 15 is a flow chart showing a subroutine for operation mode setting.

FIG. 15 shows a subroutine for operation mode setting to be carried out at step S2, which relates to selection of sheet transport path and designation of number of sheets for shifting.

At step S11, whether in course of printing or not is determined. If in course of printing, mode change is forbidden. Then, return to main routine. If not in course of printing, mode selection switch is checked at step S12. If the switch is on, necessary mode change is effected at step S13. Then, return to main routine.

Figure 16:
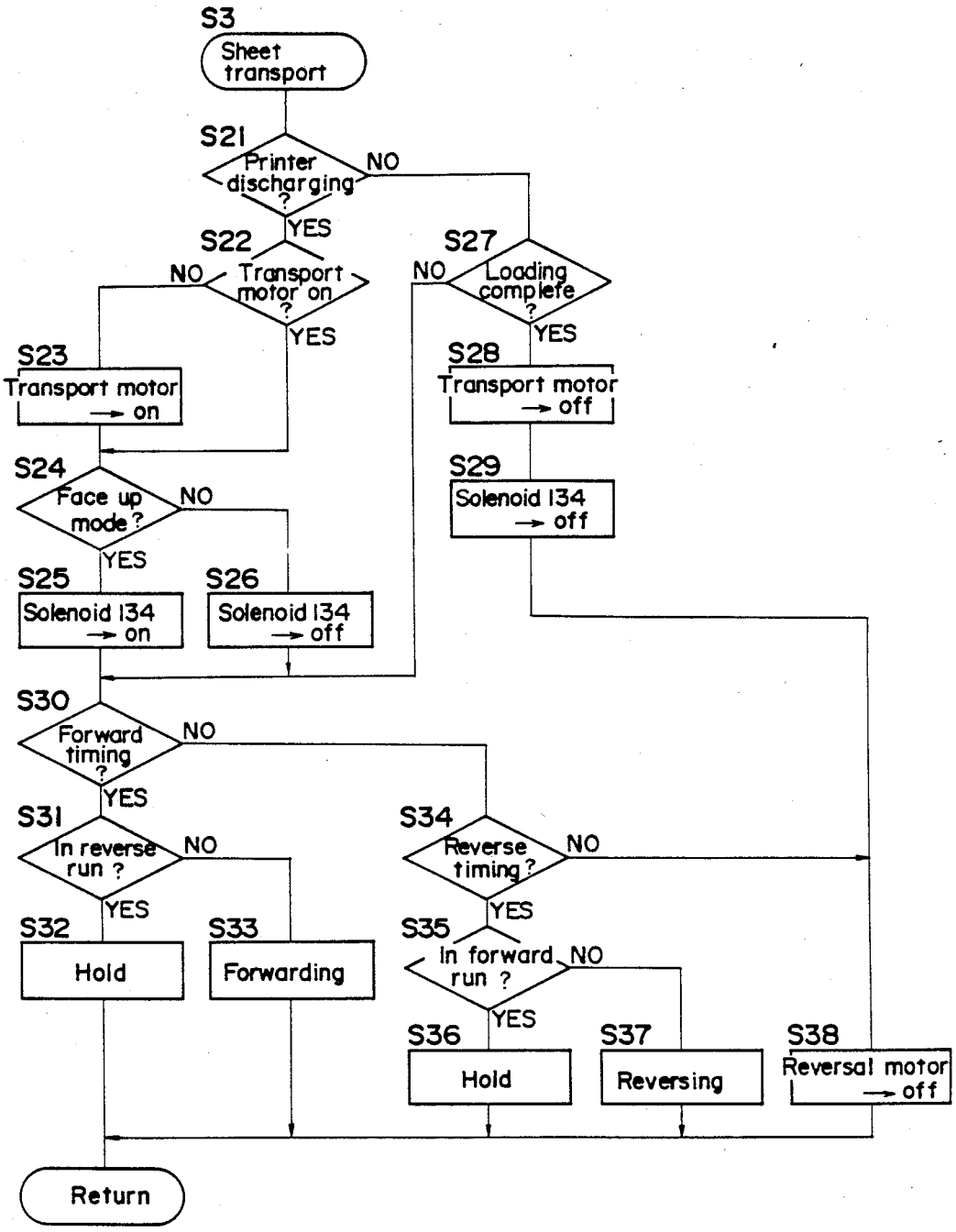
FIG. 16 is a flow chart showing a subroutine for transport of sheets.

FIG. 16 shows a subroutine for sheet transport, which is to be performed at step 83. This subroutine relates to control of the sheet transport system in the apparatus of the invention.

At step S21, whether the printer 1 is in course of sheet discharge or not is determined. If sheets are being discharged, whether transport motor is on or not is determined. If not on, the transport motor is turned on at step S23. Accordingly, rollers 121, 122, 123, 124 are driven. Then, whether face-up mode is selected or not is determined. If face-up mode, solenoid 134 is turned on at step S25. If face-down mode, solenoid 134 is turned off at step S26. Accordingly, mode is changed so that sheets are guided into the path for which the changeover pawl 111 is selected.

Whilst, if decision at step S21 is that the printer 1 is not in course of sheet discharge. Whether all sheets under transport have been received into the tray 211 or not is determined. If all sheets have been received, transport motor is turned off at step S28, and solenoid 134 is turned off at step S29 to return the changeover pawl 111 to its original position. Further, the reversal motor 164 is turned off at step S38.

After transport path setting is effected at steps S25 and S26, or when decision at step S27 is that receipt of sheets into the tray 211 is not yet completed, control of reversal motor 164 is effected at step S30 and subsequent steps. That is, if at step S30 the sensor 128 detects passage of the rear end of a sheet and the decision is forward timing, present condition of the reversal motor 164 is checked at step S31. If in reverse run, hold instruction is given to stop the motor 164 for a while. Then, return to main routine. Subsequently, the motor is caused to run forward. If decision at step S34 is reverse timing (point of time at which the rear end of a sheet has reached point B (see FIG. 3)), present condition of the motor 164 is checked at step S35. If the motor is in forward run, hold instruction is given at step S36. Subsequently, the motor is caused to run reverse at step S37.

Figure 17:
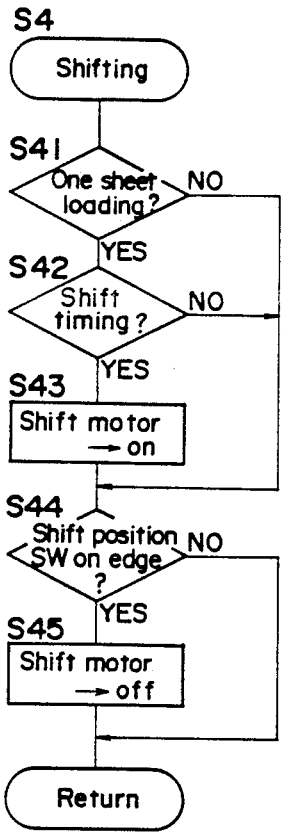
FIG. 17 is a flow chart showing a subroutine for shift motion.

FIG. 17 shows a subroutine for shift operation to be performed at step S4. This subroutine is for control of shifting for each specified number of sheets.

Each time receipt of one sheet is confirmed at step S41 (receipt of a sheet into the tray 211 is determined by a sheet rear end detection signal (off edge) from sensor 130), shift timing or not is determined at step S42. The number of sheets for shifting, together with selection of transport path, is preset. If the specified number of sheets for shifting has been loaded and decision is shift timing, the shift motor 324 is turned on at step S43. Accordingly, the shift block 300 is operated, and the tray 211 is caused to shift rightward or leftward. If on-edge signal from the shift position switch 321 is determined at step S44, the shift motor 324 is turned off at step S45. Then, return to main routine.

Figure 18A:
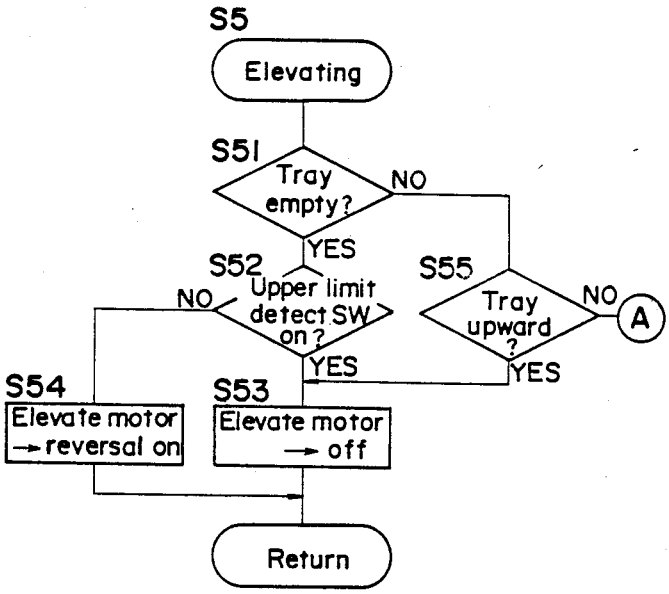
FIGS. 18*a* and 18*b* are flow charts showing subroutines for elevating motion.
Figure 18B:
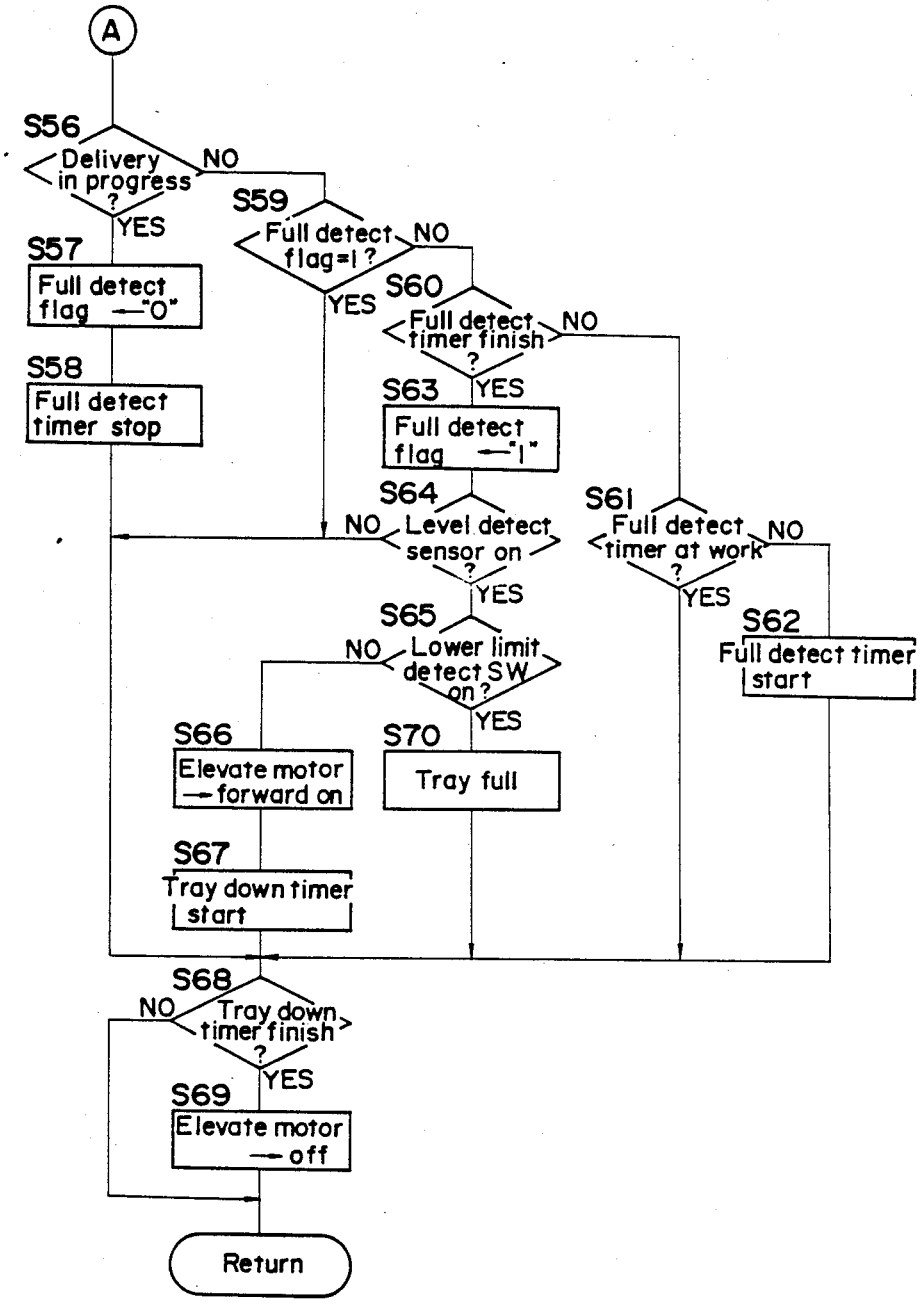

FIGS. 18*a* and 18*b* show a subroutine for elevating motion to be performed at step S5. This subroutine is for control of upward and downward movement of the tray 211.

Whether the tray 211 is empty or not is determined by the empty detection sensor 212 at step S51. If empty, whether or not the upper limit detection switch 416 is on or not is determined at step S52. If on, the elevate motor 410 is turned off at S53, because the tray 211 has already reached the upper limit position. If not on, the elevate motor 410 is driven reverse to move the tray 211 upward. Then, return to the main routine. If decision at step S51 is that sheets are present on the tray 211, whether the tray 211 is in the course of upward movement or not is determined at step S55. If the tray 211 is being elevated, the elevate motor 410 is turned off at step S53. This subroutine has now been completed.

If sheets are present on the tray 211 and if the tray 211 is not in course of upward movement, whether or not sheets are being transported to the tray 211 is determined at step S56 according to a sheet detection signal. If sheets are being transported, full detectIon flag is set to "0" at step S58, and then the full detection timer is stopped at step S58. If not in course of transport, that is, if one sheet has just been delivered toward the tray 211, whether or not full detection flag is "1" at step S59. When this routine is put in practice for the first time, full detection flag is preset at "0". Then, at step S60, whether full detection timer has finished its course or not is determined, and at step S61, whether full detection timer is in operation or not is determined. If, at this point of time, full detection timer has not started operation, and if decision at both step S60 and S61 is NO, then full detection timer is started, and after step S68, which will be described below, return to main routine. The full detection timer is set to time until the rear end of a sheet is led out from delivery rollers 123, 124 and dropped onto the tray 211.

When the detection timer having timed out, not that a sheet is being transported to the tray 211, is determined at step S60, full detection timer is set at "1" at step S63 and whether the level detection sensor 218 is on or not is determined at step S64. If the upper surface of a sheet delivered onto the tray 211 reaches the detection level of the sensor 218 and if the sensor 218 is turned on, whether the lower limit detection sensor 417 is on or not is detemined at step S65. If not on, the elevate motor 410 is driven forward to lower the tray 211 at step S66, and tray lowering timer is set to start at step S67. This timer regulates a one time amount of downward movement of the tray 211. If the timing up of the timer is determined at step S68, the elevate motor 410 is turned off at step S69 to stop the tray 211 when it is lowered a specified amount.

If it is determined that the lower limit detection switch 417 is on at step S65, a tray full signal, that is, print forbidden signal is issued to the control unit of the printer 1 at step S70, because the tray 211 is already full.

According to the above described control procedures, when a sheet is led out to the tray 211, the full detection timer starts (step S62), and if timing up of the timer is determined (YES at step S60), then the output condition of the level detection sensor 218 is ascertained (step S64). When an output signal is issued, the elevate motor 410 is turned on for a certain period of time to lower the tray 211 a predetermined amount (steps S66–S69). In this case, if leading out of a next following sheet is not yet started (NO at step S56), decision at step S59 is NO, since full detection flag is set at "1" at step S63 in a previous routine, and step S66 and subsequent steps are not carried out. Therefore, in case of defective sheet delivery, and if lowering of the tray is already started, only one time down movement is made and a subsequent down movement is forbidden, even if the level detection sensor 218 is issuing a detection signal. This prohibition is removed only when a next sheet is led out and flag is set at "0" (steps S56, S57).

It is understood that the number of times of tray down movement before receipt of a sheet is not limited to one time as in the present instance; it may be inplurality.

Other Embodiment

In the above described embodiment, as schematically shown in FIG. 19, the shift block 300 is mounted on the elevate block 400, and the elevate block 400 is mounted to the frame 51 of the transport/reversal block 100 through the brackets 405.

Figure 20:
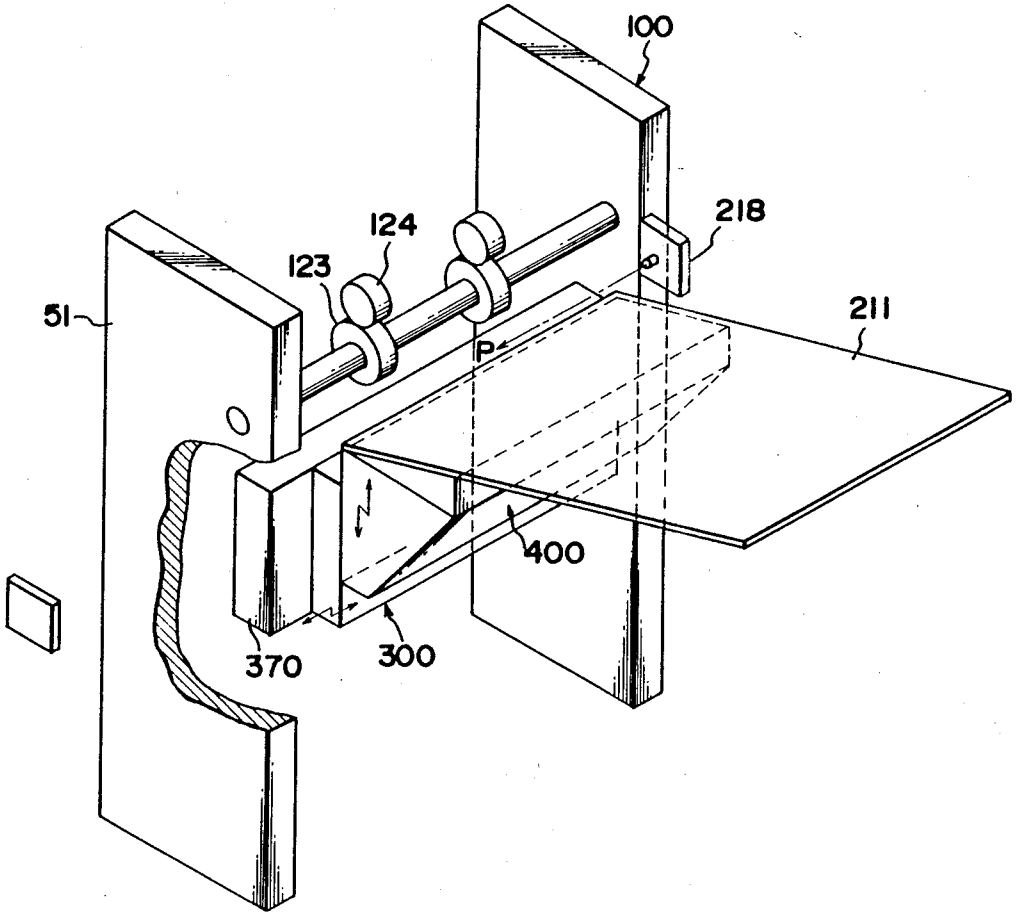
FIG. 20 is schematic perspective view showing another form of sheet holding device.

As FIG. 20 shows, however, this relationship may be reversed so that the elevate block 400 is mounted on the shift block 300 and so that the shift block 300 if mounted to the frame 51 of the transport/reversal block 100 through brackets 370.

Figure 21:
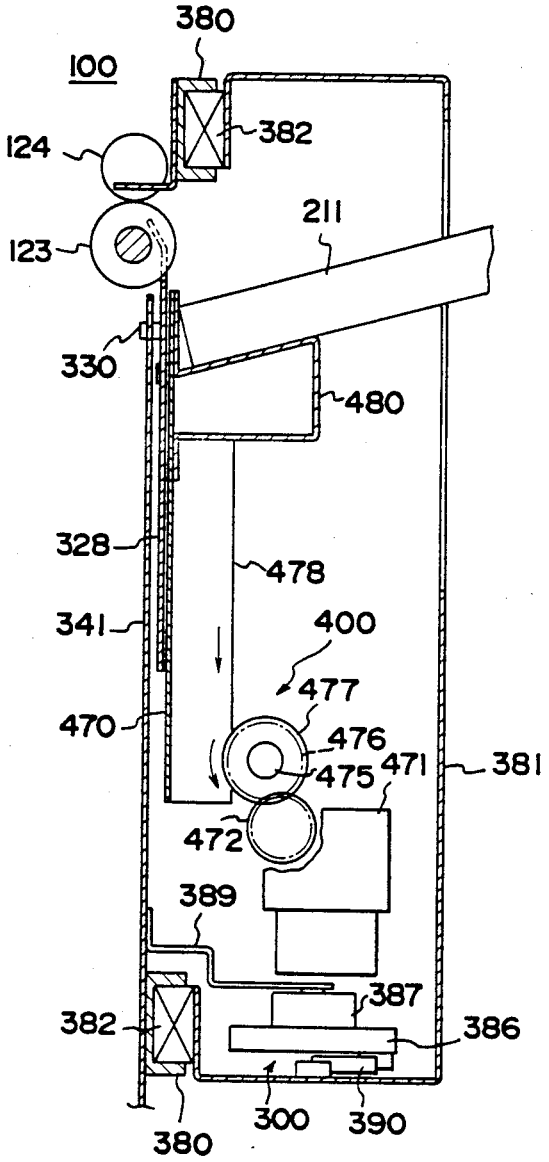
FIG. 21 is a vertical sectional view of the sheet holding device shown in FIG. 20.
Figure 22:
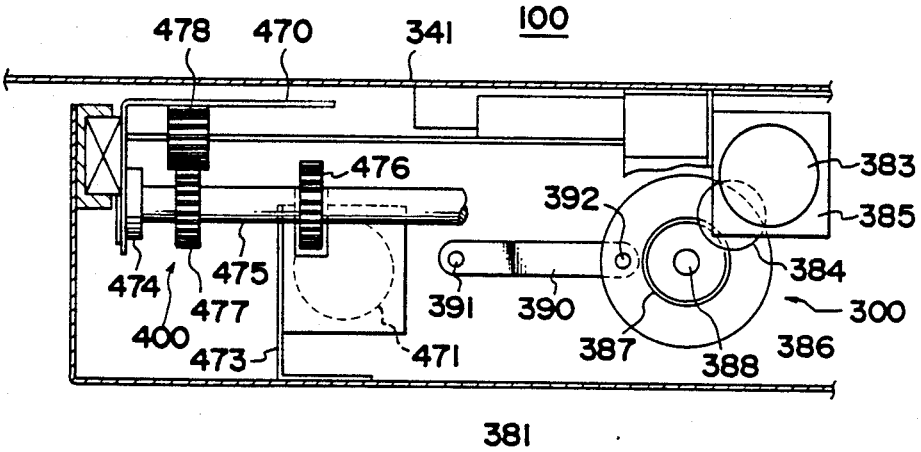
FIG. 22 is a horizontal sectional view of the device shown in FIG. 20.
Figure 23:
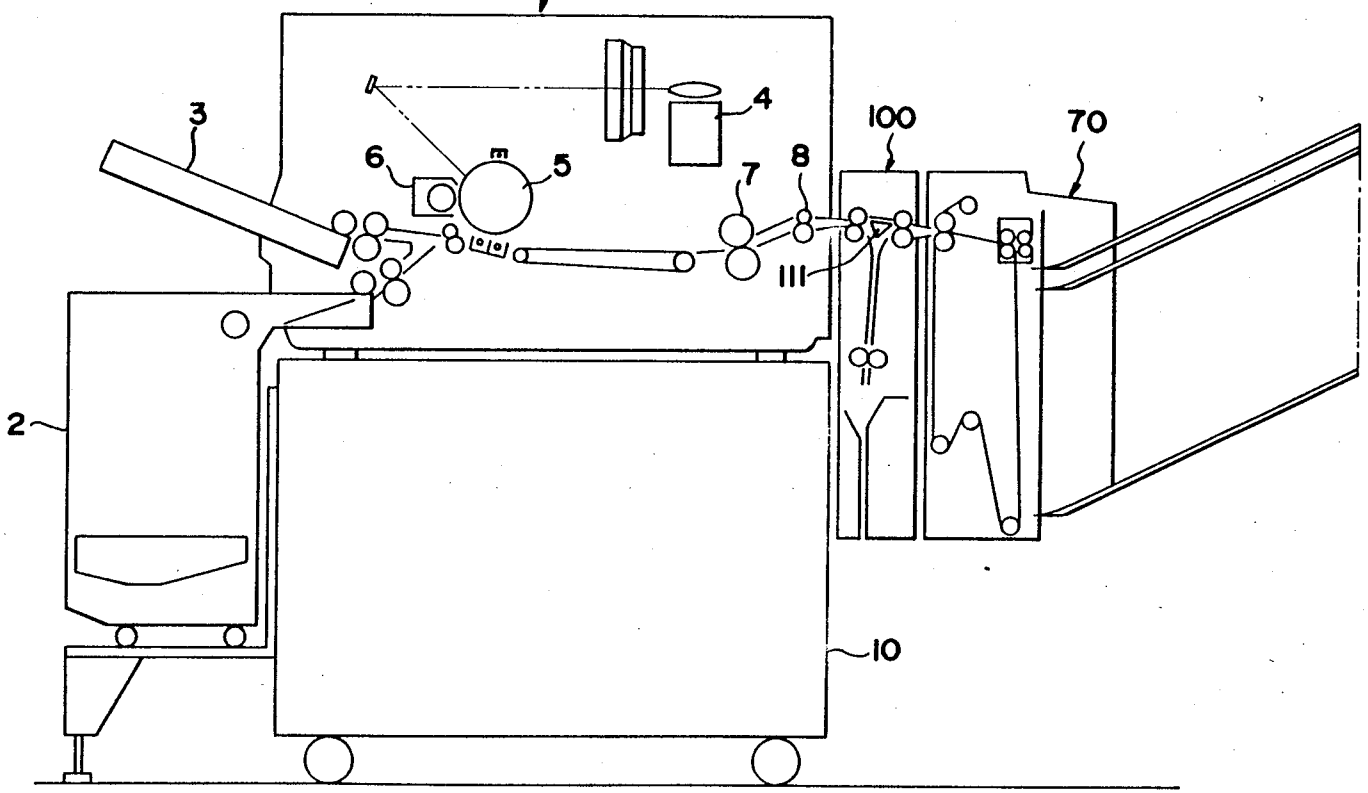
FIG. 23 is a schematic block diagram showing another embodiment of the copying apparatus according to the invention, wherein a sorter is provided.

More specifically, as FIGS. 21 and 22 show, a slide rail 382 of the shift frame 381 is in engagement with the stationary rails 380, 380 fixed to the upper and lower portions of a body back plate 341 of the transport/reversal block 100, so that the shift frame 381 is movable in the widthwise direction thereof, with the elevate frame 470 mounted in the shift frame 381, the elevate frame 470 supporting the tray 211 through a support plate 480, the tray 211 being thereby movable upward and downward.

More specifically, a shifting geared motor 383 is fixed the body back plate 341 through the support plate 385, and an output gear 384 thereof is in mesh with a gear 387 constructed integrally with a cam 386. The cam 386 is rotatably mounted through a support shaft 388 therefor to a support plate 389 fixed to the body back plate 341. One end of a link 390 is connected to the bottom of the shift frame 381 through a pin 391, the other end of the link 390 being connected to a peripheral portion of the cam 386 through a pin 392.

Therefore, as the geared motor 383 is driven to rotate the cam 386 in one direction, the link 390 is caused to move back and forth according to the eccentricity of the pin 392, so that the tray 211 is caused to shift in the widthwise direction of sheets in conjunction with the shift frame 381.

A reversible geared motor 471 for elevating operation is fixed to the shift frame 381 through a support plate 473, an output gear 472 thereof being in mesh with a gear 476. The gear 476 is fixed to a drive shaft 475 mounted in the shift frame 381 through bearings 474, and a pinion 477 fixed to the drive shaft 475 is in mesh with a rack 478. The tray 211 is mounted to an upper portion of the elevate frame 470 through a support plate 480.

Therefore, as the geared motor 471 is driven forward to rotate the pinion 477 counterclockwise in FIG. 15 through the output gear 472, the tray 211 is caused to lower in conjunction with the elevate frame 470. When the geared motor 471 is driven reverse, the tray 211 is moved upward.

Other Embodiments for Tray Shifting

In the foregoing embodiments, the tray 211 is straightforwardly shifted in the widthwise direction of sheets. Alternatively, the pattern of shifting may be such that the tray 211 is pivotally moved about one fulcrum, or such that the tray 211 is pivotally moved at two fulcrums by a link mechanism.

Although the present invention has been described in connection with the preferred embodiments thereof, it is to be noted that various changes and modifications are apparent to those skilled in the art. Such changes and modifications are to be understood as included within the scope of the present invention as defined by the appended claims, unless they depart therefrom.

What is claimed is:

1. A copying apparatus including image forming means for forming an image on a sheet, and sheet holding means for holding therein sheets each having an image formed thereon, said sheet holding means comprising:

an inclined sheet holding plate, a sheet regulating member for regulating respective rear ends of sheets loaded on the sheet holding plate, means for lowering the sheet holding plate parallel with said regulating member in the vertical direction according to the volume of sheets loaded thereon, means for shifting the sheet holding plate on a horizontal plane each time a specified volume of sheets is loaded thereon, and means for moving the sheet regulating member in integral relation with a horizontal movement of the sheet holding plate.

2. A copying apparatus as claimed in claim 1, wherein the sheet regulating member is not movable in concert with a vertical movement of the sheet holding plate and is held stationary during such movement of the latter.

3. A copying apparatus including sheet feeding means for feeding sizes of sheets to said copying apparatus, image forming means for forming images on the sheets fed by said sheet feeding means, and sheet holding means for holding the sheets, each of which has an image formed thereon by said image forming means, said sheet holding means comprising:

a sheet holding plate on which the image-formed sheets are stacked;

delivering means for delivering the image-formed sheets to said sheet holding plate; and a shift mechanism for shifting the sheet holding plate in a horizontal direction relative to said delivering means in response to a specified timing control, wherein said delivering means includes a plurality of delivery rollers coaxially disposed in parallel, two outermost ones of said delivery rollers being so disposed that their respective inner sides do not interfere with either side edge of the sheets on the sheet holding plate during shifting movement of said holding plate.

* * * * *